US011688534B2

(12) United States Patent
Kaneko et al.

(10) Patent No.: US 11,688,534 B2
(45) Date of Patent: Jun. 27, 2023

(54) PROCESS FOR PRODUCING R-T-B-BASED RARE EARTH MAGNET PARTICLES, R-T-B-BASED RARE EARTH MAGNET PARTICLES, AND BONDED MAGNET

(71) Applicant: TODA KOGYO CORP., Hiroshima (JP)

(72) Inventors: Shohei Kaneko, Otake (JP); Kuniyoshi Shigeoka, Otake (JP); Nobuhiro Katayama, Otake (JP); Koichiro Morimoto, Otake (JP)

(73) Assignee: TODA KOGYO CORP., Hiroshima (JP)

( * ) Notice: Subject to any disclaimer, the term of this patent is extended or adjusted under 35 U.S.C. 154(b) by 518 days.

(21) Appl. No.: 15/010,539

(22) Filed: Jan. 29, 2016

(65) Prior Publication Data

US 2016/0225500 A1 Aug. 4, 2016

(30) Foreign Application Priority Data

Jan. 29, 2015 (JP) ..... 2015-015215
Aug. 24, 2015 (JP) ..... 2015-165226

(51) Int. Cl.
*H01F 1/08* (2006.01)
*B22F 9/02* (2006.01)
(Continued)

(52) U.S. Cl.
CPC ..... *H01F 1/083* (2013.01); *B22F 9/023* (2013.01); *C22C 38/002* (2013.01);
(Continued)

(58) Field of Classification Search
None
See application file for complete search history.

(56) References Cited

U.S. PATENT DOCUMENTS 5,993,732 A 11/1999 Nakayama et al.
2004/0144449 A1* 7/2004 Shimada ..... H01F 1/0579 148/105
(Continued)

FOREIGN PATENT DOCUMENTS

CN 101826386 9/2010
CN 101850425 A * 10/2010
(Continued)

OTHER PUBLICATIONS

Machine translation of JP2014-075373A. (Year: 2014).*
(Continued)

*Primary Examiner* — Xiaowei Su
(74) *Attorney, Agent, or Firm* — Nixon & Vanderhye, P.C.

(57) ABSTRACT

A process for producing R-T-B-based rare earth magnet powder having excellent coercive force and high remanent flux density. A process for producing R-T-B-based rare earth magnet powder by HDDR treatment, in which a raw material alloy for the R-T-B-based rare earth magnet powder includes R (wherein R represents at least one rare earth element including Y), T (wherein T represents Fe, or Fe and Co) and B (wherein B represents boron), and has a composition including R in an amount of between 12.0 atom % and 17.0 atom %, and B in an amount of between 4.5 atom % and 7.5 atom %; the HDDR treatment includes a DR step including a preliminary evacuation step and a complete evacuation step; and a rate of pressure reduction caused by evacuation in the preliminary evacuation step is not less than 1 kPa/min and not more than 30 kPa/min.

9 Claims, 2 Drawing Sheets

(51) Int. Cl.

| | |
|---|---|
| ***H01F 1/053*** | (2006.01) |
| ***C22C 38/14*** | (2006.01) |
| ***C22C 38/10*** | (2006.01) |
| ***C22C 38/06*** | (2006.01) |
| ***C22C 38/00*** | (2006.01) |
| ***H01F 1/057*** | (2006.01) |

(52) U.S. Cl.

CPC ..... *C22C 38/005* (2013.01); *C22C 38/06* (2013.01); *C22C 38/10* (2013.01); *C22C 38/14* (2013.01); *H01F 1/0573* (2013.01); *B22F 2201/013* (2013.01); *B22F 2203/13* (2013.01); *B22F 2301/355* (2013.01); *B22F 2998/10* (2013.01); *C22C 2202/02* (2013.01); *H01F 1/0572* (2013.01); *H01F 1/0578* (2013.01)

(56) References Cited

U.S. PATENT DOCUMENTS

| | | | | |
|---|---|---|---|---|
| 2005/0016632 | A1* | 1/2005 | Tomizawa | C22C 1/0441 148/105 |
| 2005/0028892 | A1* | 2/2005 | Sasaki | B22F 1/0007 148/302 |
| 2005/0067052 | A1 | 3/2005 | Honkura et al. | |
| 2006/0048855 | A1* | 3/2006 | Honkura | H01F 41/0293 148/105 |
| 2007/0240788 | A1 | 10/2007 | Nakamura et al. | |
| 2011/0315913 | A1 | 12/2011 | Shigeoka et al. | |
| 2014/0266525 | A1 | 9/2014 | Katayama et al. | |
| 2014/0326363 | A1* | 11/2014 | Katayama | C22C 38/00 148/105 |

FOREIGN PATENT DOCUMENTS

| | | | | |
|---|---|---|---|---|
| CN | 103667918 | | 3/2014 | |
| EP | 1 845 536 | | 10/2007 | |
| EP | 2 394 761 | | 12/2011 | |
| EP | 2 755 214 | | 7/2014 | |
| EP | 2 779 179 | | 9/2014 | |
| JP | 07090308 | A * | 4/1995 | H01F 1/0573 |
| JP | 9-165601 | | 6/1997 | |
| JP | 2001/076917 | | 3/2001 | |
| JP | 2002-093610 | | 3/2002 | |
| JP | 2010-255098 | | 11/2010 | |
| JP | 2011-049441 | | 3/2011 | |
| JP | WO 2011/145674 | | 11/2011 | |
| JP | WO 2013/035628 | | 3/2013 | |
| JP | 2014075373 | A * | 4/2014 | B22F 1/0003 |
| WO | WO-2013035628 | A1 * | 3/2013 | C22C 38/00 |

OTHER PUBLICATIONS

Machine translation of JP07-090308A. (Year: 1995).*
Machine translation of CN-101850425-A. (Year: 2010).*
Chen, Journal of Alloys and Compounds, 2012, vol. 516, p. 73-77). (Year: 2012).*
Extended European Search Report issued in App. No. 16153204.9 dated Jul. 11, 2016.
Igarashi et al., "Production of Anisotropic Nd—Fe—B HDDR Powder with High Coercivity," *Proceedings of the Sixteenth International Workshop on Rare-Earth Magnets and Their Applications*, pp. 865-871 (2000).
Morimoto et al., "Preparation of fully dense Nd—Fe—B magnets using semi-processed HDDR powders," *Journal of Magnetism and Magnetic Materials*, vol. 265, pp. 345-351 (2003).

* cited by examiner

PROCESS FOR PRODUCING R-T-B-BASED RARE EARTH MAGNET PARTICLES, R-T-B-BASED RARE EARTH MAGNET PARTICLES, AND BONDED MAGNET

TECHNICAL FIELD

The present invention relates to R-T-B-based rare earth magnet powder.

BACKGROUND ART

R-T-B-based rare earth magnet powder have excellent magnetic properties and have been extensively used in the industrial applications such as magnets for various motors employed in automobiles, etc. However, the R-T-B-based rare earth magnet powder tend to suffer from large change in magnetic properties depending upon a temperature, and therefore tend to be rapidly deteriorated in coercive force under a high-temperature condition. For this reason, it has been required to previously produce magnet powder having a high coercive force by themselves to ensure high coercive force thereof even under a high-temperature condition. In order to enhance coercive force of the magnet powder, there are a method of adding any element in a slight amount do as to change the basic properties, a method of miniaturization of crystal powderize and a method of controlling crystal grain boundary.

In Patent Literature 1, it is described that an R-T-B-based alloy to which a trace amount of Dy is added is subjected to HDDR treatment (hydrogenation-decomposition-desorption-recombination) to obtain magnet powder having excellent coercive force.

In Patent Literature 2, it is described that diffusing powder comprising a hydride of Dy or the like are mixed in $RFeBH_x$ powder, and the resulting mixed powder are subjected to diffusion heat treatment step and hydrogen desorption step to thereby obtain magnet powder having excellent coercive force which comprise Dy or the like diffused on a surface of the powder and inside thereof.

In Patent Literature 3, it is described that Zn-containing powder are mixed in R—Fe—B-based magnet powder produced by HDDR treatment, and the resulting mixed powder are subjected to mixing and pulverization, diffusion heat treatment and aging heat treatment to thereby obtain magnet powder having excellent coercive force which comprise Zn diffused in a grain boundary thereof.

In Patent Literature 4, it is described that Nd—Cu powder are mixed in R—Fe—B-based magnet powder produced by HDDR treatment, and the resulting mixed powder are subjected to heat treatment and diffusion to diffuse Nd—Cu in a grain boundary thereof as a main phase to obtain magnet powder having excellent coercive force.

In addition, in Patent Literature 5, it is described that R-T-B-based rare earth magnet powder having excellent coercive force can be obtained by controlling a content of R and a content of Al in a grain boundary phase thereof even without using expensive scarce resources such as Dy or the like.

CITATION LIST

Patent Literature

Patent Literature 1: Japanese Patent Application Laid-Open (KOKAI) No. 9-165601(1997)

Patent Literature 2: Japanese Patent Application Laid-Open (KOKAI) No. 2002-093610

Patent Literature 3: Japanese Patent Application Laid-Open (KOKAI) No. 2011-049441

Patent Literature 4: PCT Pamphlet WO 2011/145674

Patent Literature 5: PCT Pamphlet WO 2013/035628

SUMMARY OF INVENTION

Technical Problem

There have been conventionally studied various methods for enhancing coercive force of magnet powder. However, there tends to arise such a problem that if the coercive force of magnet powder is enhanced by adding an additive element such as Dy or the like as described in Patent Literatures 1 to 5 thereto, the additive element is also included into a $Nd_2Fe_{14}B$ magnetic phase, thereby causing deterioration in remanent flux density of the magnet powder.

An object of the present invention is to produce R-T-B-based rare earth magnet powder having excellent coercive force and high remanent flux density.

Solution to Problem

That is, according to the present invention, there is provided a process for producing R-T-B-based rare earth magnet powder by HDDR treatment, in which a raw material alloy for the R-T-B-based rare earth magnet powder comprises R (wherein R represents at least one rare earth element including Y), T (wherein T represents Fe, or Fe and Co) and B (wherein B represents boron), and has a composition comprising R in an amount of not less than 12.0 atom % and not more than 17.0 atom %, and B in an amount of not less than 4.5 atom % and not more than 7.5 atom %; the HDDR treatment comprises a DR step comprising a preliminary evacuation step and a complete evacuation step; and a rate of pressure reduction caused by evacuation in the preliminary evacuation step is not less than 1 kPa/min and not more than 30 kPa/min (Invention 1).

Also, according to the present invention, there is provided the process for producing R-T-B-based rare earth magnet powder as described in the above Invention 1, wherein a vacuum degree after the evacuation in the preliminary evacuation step is not less than 1.0 kPa and not more than 5.0 kPa (Invention 2).

Also, according to the present invention, there is provided the process for producing R-T-B-based rare earth magnet powder as described in the above Invention 1 or 2, wherein a treating temperature in the preliminary evacuation step is not lower than 800° C. and not higher than 900° C. (Invention 3).

Also, according to the present invention, there is provided the process for producing R-T-B-based rare earth magnet powder as described in any one of the above Inventions 1 to 3, wherein the raw material alloy comprises at least Nd and Pr as R (wherein R represents at least one rare earth element including Y), and a content of Pr in R is not less than 0.1 atom % and not more than 85.0 atom % (Invention 4).

Also, according to the present invention, there is provided the process for producing R-T-B-based rare earth magnet powder as described in any one of the above Inventions 1 to 4, wherein the raw material alloy further comprises Al, and has a composition comprising Al in an amount of not less than 0.1 atom % and not more than 5.0 atom % (Invention 5).

Also, according to the present invention, there is provided the process for producing R-T-B-based rare earth magnet powder as described in any one of the above inventions 1 to 5, wherein the raw material alloy further comprises Ga and Zr, and has a composition comprising Co in an amount of not more than 15.0 atom %, Ga in an amount of not less than 0.1 atom % and not more than 0.6 atom %, and Zr in an amount of not less than 0.05 atom % and not more than 0.15 atom % (Invention 6).

Further, according to the present invention, there are provided R-T-B-based rare earth magnet powder produced by the process as described in any one of the above Inventions 1 to 6 (Invention 7).

Furthermore, according to the present invention, there is provided a process for producing a resin composition for bonded magnets, comprising the step of mixing and kneading 85 to 99% by weight of the R-T-B-based rare earth magnet powder produced by the process as described in any one of the above Inventions 1 to 6 with 15 to 1% by weight of a total amount of a binder resin and an additive (Invention 8).

Also, according to the present invention, there is provided the process for producing a resin composition for bonded magnets as described in the above invention 8, further comprising the step of subjecting the R-T-B-based rare earth magnet powder to surface treatment using a phosphoric acid compound and/or a silane coupling agent (Invention 9).

In addition, according to the present invention, there is provided a bonded magnet using the resin composition for bonded magnets produced by the process as described in the above Invention 8 or 9 (Invention 10).

Advantageous Effects of Invention

In accordance with the present invention, it is possible to obtain R-T-B-based rare earth magnet powder having excellent remanent flux density by controlling a rate of pressure reduction in a preliminary evacuation step in HDDR treatment to a level lower than that used in the conventional arts.

In addition, in the case where Nd and Pr are used as the rare earth element R constituting the R-T-B-based rare earth magnet powder according to the present invention, it is possible to enhance coercive force of the R-T-B-based rare earth magnet powder without causing deterioration in remanent flux density of the powder. That is, as a result of combining the former control of a rate of pressure reduction in the preliminary evacuation step and the latter use of Pr with each other, it is possible to produce the R-T-B-based rare earth magnet powder that are excellent in remanent flux density and coercive force.

DESCRIPTION OF EMBODIMENTS

Figure 1:
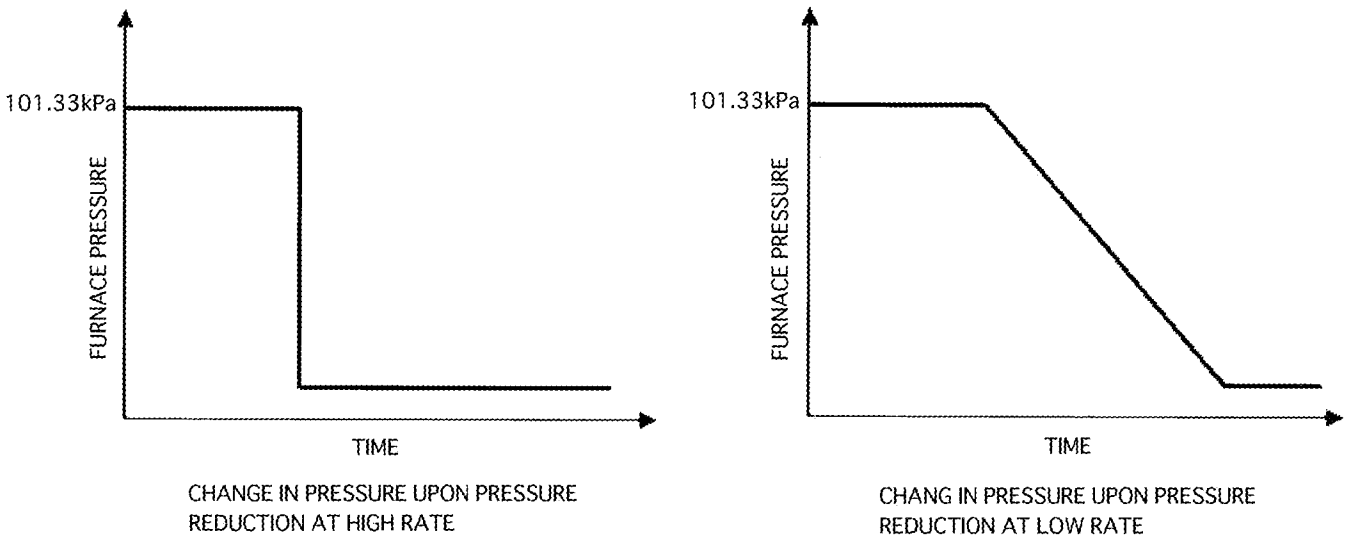
FIG. 1 shows graphs illustrating changes in furnace pressure when conducing pressure reduction in a preliminary evacuation step at a high rate and a low rate, respectively.

The process for producing R-T-B-based rare earth magnet powder according to the present invention is described in detail below.

In the process for producing R-T-B-based rare earth magnet powder according to the present invention, raw material alloy powder are subjected to HDDR treatment, and then the resulting powder are cooled to thereby produce the R-T-B-based rare earth magnet powder.

First, the raw material alloy for the R-T-B-based rare earth magnet powder according to the present invention is explained.

The raw material alloy for the R-T-B-based rare earth magnet powder according to the present invention comprises R (wherein R represents at least one rare earth element including Y), T (wherein T represents Fe, or Fe and Co) and B (wherein B represents boron).

As the rare earth element R constituting the raw material alloy for the R-T-B-based rare earth magnet powder according to the present invention, there may be used at least one element selected from the group consisting of Y, La, Ce, Pr, Nd, Pm, Sm, Eu, Gd, Tb, Dy, Ho, Er, Tm, Yb and Lu. Among these rare earth elements, from the standpoints of low cost and good magnetic properties, Nd and/or Pr are preferably used. The content of the element R in the raw material alloy is not less than 12.0 atom % and not more than 17.0 atom %. When the content of the element R in the raw material alloy is less than 12.0 atom %, a surplus amount of R diffused in the grain boundary tends to be reduced, so that it is not possible to attain a sufficient effect of enhancing coercive force of the resulting magnet powder. When the content of the element R in the raw material alloy is more than 17.0 atom %, the amount of a non-magnetic phase in the resulting magnet powder tends to be increased, so that the magnet powder tend to be deteriorated in remanent flux density. The content of the element R in the raw material alloy is preferably not less than 12.3 atom % and not more than 16.5 atom %, more preferably not less than 12.5 atom % and not more than 16.0 atom %, even more preferably not less than 12.8 atom % and not more than 15.0 atom %, and further even more preferably not less than 12.8 atom % and not more than 14.0 atom %.

The raw material alloy for the R-T-B-based rare earth magnet powder according to the present invention comprises at least Nd and Pr as R (wherein R represents at least one rare earth element including Y), and the content of Pr in R is preferably not less than 0.1 atom % and not more than 85.0 atom %. When using Pr as the rare earth element R, Pr itself can constitute a magnetic phase having a saturation magnetization value substantially equal to that of Nd, and a melting point of the grain boundary phase can be lowered to promote formation of a uniform grain boundary phase. Therefore, it is possible to increase coercive force of the resulting powder without causing deterioration in residual flux density of the resulting powder. When the content of Pr in R is more than 85.0 atom %, considerable deterioration in corrosion resistance of the resulting powder tends to be induced. The content of Pr in R of the raw material alloy is preferably not less than 1.0 atom % and not more than 85.0 atom %, more preferably not less than 10.0 atom % and not more than 70.0 atom %, and even more preferably not less than 15.0 atom % and not more than 50.0 atom %.

In the raw material alloy for the R-T-B-based rare earth magnet powder according to the present invention, the content of Nd in R therein is preferably not less than 0.1 atom % and not more than 99.9 atom %, more preferably not less than 15.0 atom % and not more than 99.0 atom %, even more preferably not less than 30.0 atom % and not more than 90.0 atom %, and further even more preferably not less than 50.0 atom % and not more than 85.0 atom %.

The element T constituting the raw material alloy for the R-T-B-based rare earth magnet powder according to the present invention is Fe, or Fe and Co. The content of the element T in the raw material alloy is the balance of the composition of the raw material alloy except for the other elements constituting the raw material alloy. In addition, when Co is added as an element with which Fe is to be substituted, it is possible to raise a Curie temperature of the raw material alloy. However, the addition of Co to the raw material alloy tends to induce deterioration in residual flux density of the resulting R-T-B-based rare earth magnet powder. Therefore, the content of Co in the raw material alloy is preferably controlled to not more than 15.0 atom %.

The content of B in the raw material alloy for the R-T-B-based rare earth magnet powder according to the present invention is not less than 4.5 atom % and not more than 7.5 atom %. When the content of B in the raw material alloy is less than 4.5 atom %, an $R_2T_{17}$ phase and the like tend to be precipitated, so that the resulting magnet powder tend to be deteriorated in magnetic properties. When the content of B in the raw material alloy is more than 7.5 atom %, the resulting R-T-B-based rare earth magnet powder tend to be deteriorated in remanent flux density. The content of B in the raw material alloy is preferably not less than 5.0 atom % and not more than 7.0 atom %.

The raw material alloy for the R-T-B-based rare earth magnet powder according to the present invention preferably further comprises Al. Al has the effect of uniformly diffusing a surplus amount of R in a grain boundary of the R-T-B-based rare earth magnet powder. It is preferred that the composition of the raw material alloy for the R-T-B-based rare earth magnet powder according to the present invention comprises Al in an amount of not less than 0.1 atom % and not more than 5.0 atom %. Further, the content of Al in the raw material alloy for the R-T-B-based rare earth magnet powder according to the present invention is preferably controlled such that the proportion of Al to R in the raw material alloy which is represented by the formula of [Al (atom %)/{(R (atom %)−12)+Al (atom %)}] falls in the range of 0.10 to 0.75. When the value of [Al (atom %)/{(R (atom %)−12)+Al (atom %)}] is less than 0.10, uniform diffusion of R in the resulting magnet powder tends to hardly proceed because R is not readily melted. On the other hand, when the value of [Al (atom %)/{(R (atom %)−12)+Al (atom %)}] is more than 0.75, the content of a non-magnetic phase in the resulting magnet powder tends to be increased, so that the magnet powder tend to be deteriorated in remanent flux density. The value of [Al (atom %)/{(R (atom %)−12)+Al (atom %)}] more preferably falls in the range of 0.25 to 0.70.

Further, the raw material alloy for the R-T-B-based rare earth magnet powder according to the present invention preferably comprises Ga and Zr. The content of Ga in the raw material alloy is preferably not less than 0.1 atom % and not more than 0.6 atom %. When the content of Ga in the raw material alloy is less than 0.1 atom %, the effect of enhancing coercive force of the resulting magnet powder tends to be lowered. When the content of Ga in the raw material alloy is more than 0.6 atom %, the resulting R-T-B-based rare earth magnet powder tend to be deteriorated in remanent flux density. In addition, the content of Zr in the raw material alloy is preferably not less than 0.05 atom % and not more than 0.15 atom %. When the content of Zr in the raw material alloy is less than 0.05 atom %, the effect of enhancing coercive force of the resulting magnet powder tends to be lowered. When the content of Zr in the raw material alloy is more than 0.15 atom %, the resulting R-T-B-based rare earth magnet powder tend to be deteriorated in remanent flux density.

In addition, the raw material alloy for the R-T-B-based rare earth magnet powder according to the present invention may also comprise, in addition to the above-mentioned elements, at least one element selected from the group consisting of Ti, V, Nb, Cu, Si, Cr, Mn, Zn, Mo, Hf, W, Ta and Sn. When adding these elements to the raw material alloy, it is possible to enhance magnetic properties of the resulting R-T-B-based rare earth magnet powder. The total content of these elements in the raw material alloy is preferably not more than 2.0 atom %. When the total content of these elements in the raw material alloy is more than 2.0 atom %, the resulting magnet powder tend to be deteriorated in remanent flux density or suffer from precipitation of the other phases.

(Production of Raw Material Alloy Powder)

As the raw material alloy for the R-T-B-based rare earth magnet powder, there may be used ingots produced by a book mold casting method or a centrifugal casting method, or strips produced by a strip casting method. These alloys tend to undergo segregation of their composition upon the casting, and therefore may be subjected to homogenization heat treatment for formation of the uniform composition before being subjected to the HDDR treatment. The homogenization heat treatment may be carried out in a vacuum atmosphere or in an inert gas atmosphere at a temperature of preferably not lower than 950° C. and not higher than 1200° C. and more preferably not lower than 1000° C. and not higher than 1200° C. When the raw material alloy is in the form of an ingot, the raw material alloy may be subjected to coarse pulverization and fine pulverization to thereby produce raw material alloy powder for the HDDR treatment. The coarse pulverization may be carried out using a jaw crusher or the like. Thereafter, the resulting powder may be subjected to ordinary hydrogen absorbing pulverization and mechanical pulverization to thereby produce raw material alloy powder for the R-T-B-based rare earth magnet powder.

Next, the process for producing the R-T-B-based rare earth magnet powder using the above raw material alloy powder is explained.

(HDDR Treatment)

The HDDR treatment includes an HD step in which an R-T-B-based raw material alloy is subjected to hydrogenation to decompose the alloy into an α-Fe phase, an RH, phase and an $Fe_2B$ phase, and a DR step in which hydrogen is discharged under reduced pressure so that a reverse reaction of the above step is caused to produce $R_2Fe_{14}B$ from the above respective phases. The evacuation step of the DR step includes a preliminary evacuation step and a complete evacuation step.

(HD Step)

The HD step is preferably carried out at a treating temperature of not lower than 700° C. and not higher than 870° C. The reason why the treating temperature is adjusted to not lower than 700° C. is that when the treating temperature is lower than 700° C., the reaction may fail to proceed. Also, the reason why the treating temperature is adjusted to not higher than 870° C. is that when the treating temperature is higher than 870° C., hydrogenation-decomposition reaction tends to hardly proceed, so that the resulting magnet powder tend to be deteriorated in coercive force. The atmosphere used in the HD step is preferably a mixed gas atmosphere of a hydrogen gas and an inert gas having a hydrogen partial pressure of not less than 20 kPa and not more than 90 kPa, based on atmospheric pressure as a whole. The hydrogen partial pressure in the mixed gas atmosphere is more preferably not less than 40 kPa and not more than 80 kPa. The reason for controlling the hydrogen partial pressure in the mixed gas atmosphere to the above-specified range is as follows. That is, when the hydrogen partial pressure is less than 20 kPa, the reaction tends to hardly proceed, whereas when the hydrogen partial pressure is more than 90 kPa, the reaction tends to be hardly controlled to a sufficient extent, so that the resulting magnet powder tend to be deteriorated in magnetic properties. The treating time of the HD step is preferably not less than 30 min and not more than 10 hr, and more preferably not less than 1 hr and not more than 7 hr.

(Atmosphere Replacing Step)

If the process is transferred to the DR step immediately after completion of the HD step, a large amount of hydrogen tends to be discharged at one time. Therefore, in the course of transferring from the HD step to the DR step, there may be provided an atmosphere replacing step in which an inside atmosphere of the furnace is replaced with Ar and the Ar atmosphere thus replaced is maintained for a certain period of time. The atmosphere replacing step is preferably conducted at a treating temperature of not lower than 700° C. and not higher than 870° C. The treating time of the atmosphere replacing step is preferably not less than 1 min and not more than 30 min, and more preferably not less than 2 min and not more than 20 min.

(DR Step: Preliminary Evacuation Step)

The preliminary evacuation step is conducted at a treating temperature of not lower than 800° C. and not higher than 900° C. The reason why the treating temperature of the preliminary evacuation step is adjusted to not lower than 800° C. is that when the treating temperature is lower than 800° C., the hydrogen desorption tends to hardly proceed. Whereas, the reason why the treating temperature of the preliminary evacuation step is adjusted to not higher than 900° C. is that when the treating temperature is higher than 900° C., the resulting powder tends to be deteriorated in coercive force owing to excessive growth of crystal grains therein. In the preliminary evacuation step, the vacuum degree is preferably adjusted to not less than 1.0 kPa and not more than 5.0 kPa, and more preferably not less than 2.5 kPa and not more than 4.0 kPa. The reason therefor is that hydrogen must be removed from an $RH_2$ phase. When removing hydrogen from the $RH_2$ phase in the preliminary evacuation step, it is possible to obtain an RFeBH phase having a uniform crystal orientation. Since the hydrogen desorption reaction in the preliminary evacuation step is an endothermic reaction, temporary drop in temperature of the resulting product tends to be induced. Therefore, it is preferred that the preliminary evacuation step is completed after holding the system for not less than 1 min and not more than 300 min from the time at which the variation in temperature of the resulting product per 1 min falls within the range of 0.5° C. or less after completion of drop and subsequent rise in temperature of the resulting product.

In the present invention, the rate of pressure reduction caused by evacuation in the preliminary evacuation step is not less than 1 kPa/min and not more than 30 kPa/min. When conducting the pressure reduction at such a low rate, the hydrogen desorption-recombination reaction is allowed to proceed slowly, thereby enhancing the remanent flux density (Br) of the resulting magnet powder which is attained by aligning crystal orientation of the recombined powder in one direction. When the rate of pressure reduction in the preliminary evacuation step is less than 1 kPa/min, the effect of enhancing the remanent flux density of the resulting magnet powder tends to be already saturated. Further, the treating time upon the pressure reduction tends to be prolonged and the coercive force of the resulting magnet powder tends to be deteriorated to a large extent. On the other hand, when the rate of pressure reduction in the preliminary evacuation step is more than 30 kPa/min, the effect of enhancing the remanent flux density of the resulting magnet powder tends to be hardly attained to a sufficient extent. The rate of pressure reduction in the preliminary evacuation step is preferably not less than 2 kPa/min and not more than 20 kPa/min, more preferably not less than 2.5 kPa/min and not more than 18 kPa/min, and even more preferably not less than 3 kPa/min and not more than 15 kPa/min. In addition, the rate of pressure reduction in the preliminary evacuation step may be always held constant or changed during the evacuation. In the case where the rate of pressure reduction in the preliminary evacuation step is changed, the rate of pressure reduction is preferably changed within the above-specified range. In the present invention, "constant evacuation" includes a case where a rate of pressure reduction is varied within % from the average evacuation. As one example, in FIG. 1, there is shown the comparison between changes in furnace pressure when conducting the pressure reduction at a high rate and at a low rate, respectively.

(DR Step: Complete Evacuation Step)

The complete evacuation step may also be conducted at a treating temperature of not lower than 800° C. and not higher than 900° C. similarly to the preliminary evacuation step. The reason why the treating temperature of the complete evacuation step is adjusted to not lower than 800° C. is that when the treating temperature is lower than 800° C., the hydrogen desorption reaction tends to hardly proceed to a sufficient extent, so that the resulting magnet powder tend to be hardly improved in coercive force. On the other hand, the reason why the treating temperature of the complete evacuation step is adjusted to not higher than 900° C. is that when the treating temperature is higher than 900° C., the resulting magnet powder tends to be deteriorated in coercive force owing to excessive growth of crystal grains therein. In the complete evacuation step, the atmosphere used in the preliminary evacuation step is subjected to further evacuation until finally reaching a vacuum degree of not more than 1 Pa. Since the hydrogen desorption reaction in the complete evacuation step is an endothermic reaction as in the preliminary evacuation step, temporary drop in temperature of the resulting product tends to be induced. Therefore, it is preferred that the vacuum degree in the complete evacuation step is held for a period of not less than 1 min and not more than 150 min from the time at which the variation in temperature of the resulting product per 1 min falls within the range of 0.5° C. or less after completion of drop and subsequent rise in temperature of the resulting product. The vacuum degree may be dropped continuously or stepwise.

After completion of the complete evacuation step, the resulting powder are cooled.

Next, the R-T-B-based rare earth magnet powder according to the present invention are described.

The R-T-B-based rare earth magnet powder according to the present invention comprise R (wherein R represents at least one rare earth element including Y), T (wherein T represents Fe, or Fe and Co), and B (wherein B represents boron).

As the rare earth element R constituting the R-T-B-based rare earth magnet powder according to the present invention, there may be used at least one element selected from the group consisting of Y, La, Ce, Pr, Nd, Pm, Sm, Eu, Gd, Tb, Ho, Er, Tm, Yb and Lu. Among these rare earth elements, from the standpoints of low cost and good magnetic properties, Nd and/or Pr are preferably used. The R-T-B-based rare earth magnet powder have an average composition comprising R in an amount of not less than 12.0 atom % and not more than 17.0 atom %. When the average composition of the magnet powder comprises R in an amount of less than 12.0 atom %, the content of R in the grain boundary phase of the resulting magnet powder tends to be reduced, so that it is not possible to attain a sufficient effect of enhancing coercive force of the resulting magnet powder. When the average composition of the magnet powder comprises R in an amount of more than 17.0 atom %, the content of the grain boundary phase having a low magnetization in the magnet powder tends to be increased, so that the resulting magnet powder tend to be deteriorated in remanent flux density. The content of R in the average composition of the magnet powder is preferably not less than 12.3 atom % and not more than 16.5 atom %, more preferably not less than 12.5 atom % and not more than 16.0 atom %, even more preferably not less than 12.8 atom % and not more than 15.0 atom %, and further even more preferably not less than 12.8 atom % and not more than 14.0 atom %.

As the rare earth element R constituting the R-T-B-based rare earth magnet powder according to the present invention, there are preferably used at least Nd and Pr. The content of Pr in R in the magnet powder is preferably not less than 0.1 atom % and not more than 85.0 atom %. When using Pr as the rare earth element R, Pr itself can constitute a magnetic phase, and a melting point of the grain boundary phase can be lowered to thereby promote formation of a uniform grain boundary phase. As a result, it is possible to produce the R-T-B-based rare earth magnet powder having excellent coercive force and high residual flux density. When the content of Pr in R is more than 85.0 atom %, considerable deterioration in corrosion resistance of the resulting powder tends to be induced. The content of Pr in R in the R-T-B-based rare earth magnet powder is preferably not less than 1.0 atom % and not more than 85.0 atom %, more preferably not less than 10.0 atom % and not more than 70.0 atom %, and even more preferably not less than 15.0 atom % and not more than 50.0 atom %.

In addition, the content of Nd in R in the R-T-B-based rare earth magnet powder is preferably not less than 0.1 atom % and not more than 99.9 atom %. The content of Nd in R in the R-T-B-based rare earth magnet powder is more preferably not less than 15.0 atom % and not more than 99.0 atom %, even more preferably not less than 30.0 atom % and not more than 90.0 atom %, and further even more preferably not less than 50.0 atom % and not more than 85.0 atom %.

The element T constituting the R-T-B-based rare earth magnet powder according to the present invention is Fe, or Fe and Co. The content of the element T in the average composition of the magnet powder is the balance of the composition of the magnet powder except for the other elements constituting the magnet powder. In addition, when Co is further added as an element with which Fe is to be substituted, it is possible to raise a Curie temperature of the magnet powder. However, the addition of Co to the magnet powder tends to induce deterioration in residual flux density of the resulting magnet powder. Therefore, the content of Co in the average composition of the magnet powder is preferably controlled to not more than 15.0 atom %.

The content of B in the average composition of the R-T-B-based rare earth magnet powder according to the present invention is not less than 4.5 atom % and not more than 7.5 atom %. When the content of B in the average composition of the magnet powder is less than 4.5 atom %, an $R_2T_{17}$ phase and the like tend to be precipitated, so that the resulting magnet powder tend to be deteriorated in magnetic properties. When the content of B in the average composition of the magnet powder is more than 7.5 atom %, the resulting magnet powder tend to be deteriorated in remanent flux density. The content of B in the average composition of the magnet powder is preferably not less than 5.0 atom % and not more than 7.0 atom %.

In addition, the R-T-B-based rare earth magnet powder according to the present invention preferably further comprise Ga and Zr. The content of Ga in the average composition of the magnet powder is preferably not less than 0.1 atom % and not more than 0.6 atom %. When the content of Ga in the average composition of the magnet powder is less than 0.1 atom %, the effect of enhancing coercive force of the resulting magnet powder tends to be lowered. When the content of Ga in the average composition of the magnet powder is more than 0.6 atom %, the resulting magnet powder tend to be deteriorated in remanent flux density. Also, the content of Zr in the average composition of the magnet powder is preferably not less than 0.05 atom % and not more than 0.15 atom %. When the content of Zr in the average composition of the magnet powder is less than 0.05 atom %, the effect of enhancing remanent flux density of the resulting magnet powder tends to be lowered. When the content of Zr in the average composition of the magnet powder is more than 0.15 atom %, the resulting magnet powder tend to be deteriorated in remanent flux density.

The R-T-B-based rare earth magnet powder according to the present invention preferably further comprise Al. It is considered that Al has the effect of uniformly diffusing a surplus amount of R in a grain boundary of the R-T-B-based rare earth magnet powder. The content of Al in the average composition of the R-T-B-based rare earth magnet powder according to the present invention is preferably not less than 0.1 atom % and not more than 5.0 atom %. When the content of Al in the average composition of the R-T-B-based rare earth magnet powder according to the present invention is less than 0.1 atom %, the effect of improving coercive force of the resulting magnet powder tends to be lowered. When the content of Al in the average composition of the R-T-B-based rare earth magnet powder according to the present invention is more than 5.0 atom %, the resulting magnet powder tend to be considerably deteriorated in remanent flux density.

Further, the R-T-B-based rare earth magnet powder according to the present invention may also comprise, in addition to the above-mentioned elements, at least one element selected from the group consisting of Ti, V, Nb, Cu, Si, Cr, Mn, Zn, Mo, Hf, W, Ta and Sn. When adding these elements to the magnet powder, it is possible to enhance magnetic properties of the resulting R-T-B-based rare earth magnet powder. The total content of these elements in the magnet powder is preferably not more than 2.0 atom %. When the total content of these elements in the magnet powder is more than 2.0 atom %, the resulting magnet powder may be deteriorated in remanent flux density.

The R-T-B-based rare earth magnet powder according to the present invention comprise crystal grains comprising an $R_2T_{14}B$ magnetic phase, and a grain boundary phase. In the R-T-B-based rare earth magnet powder according to the present invention, magnetic exchange coupling between the individual crystal powder is weakened, so that the resulting magnet powder can exhibit an excellent coercive force.

The R-T-B-based rare earth magnet powder according to the present invention have excellent magnetic properties. The coercive force (iHc) of the R-T-B-based rare earth magnet powder is usually not less than 1100 kA/m, and preferably not less than 1200 kA/m. The maximum energy product ($(BH)_{max}$) of the R-T-B-based rare earth magnet powder is usually not less than 195 kJ/m$^3$, and preferably not less than 220 kJ/m$^3$. The remanent flux density (Br) of the R-T-B-based rare earth magnet powder is usually not less than 1.05 T, and preferably not less than 1.20 T.

Next, the resin composition for bonded magnets according to the present invention is described.

The resin composition for bonded magnets according to the present invention may be prepared by dispersing the R-T-B-based rare earth magnet powder in a binder resin, and comprises the R-T-B-based rare earth magnet powder in an amount of 85 to 99% by weight, and the balance comprising the binder resin and other additives. The resin composition for bonded magnets preferably comprises 85 to 99% by weight of the R-T-B-based rare earth magnet powder and 15 to 1% by weight of a sum of the binder resin and additives, and more preferably 87 to 99% by weight of the R-T-B-based rare earth magnet powder and 13 to 1% by weight of a sum of the binder resin and additives.

In the present invention, it is preferred that the powderize distribution of the magnet powder used for production of the bonded magnet is adjusted to the predetermined range, and there may be used those powder prepared by pulverizing the magnet powder obtained by the aforementioned process, or mixed powder comprising two or more kinds of magnet powder which are different in particle diameter from each other. The average particle diameter of the magnet powder used for production of the bonded magnet in the present invention is usually 20 to 150 μm, and preferably 30 to 100 μm. When the average particle diameter of the magnet powder is excessively small, the resulting powder tend to be deteriorated in molding property in the injection molding process. On the other hand, when the average particle diameter of the magnet powder is excessively large, the gate diameter of molded product is quite limited so that the design freedom of product is reduced, the competitiveness deteriorated and the application variety is narrowed.

The magnet powder used for production of the bonded magnet according to the present invention is desirably subjected to various surface treatments in order to prevent deterioration in magnetic properties of the magnet powder owing to oxidation thereof, and improve compatibility with resins and strength of the resulting molded product. As the material with which the magnet powder can be surface-treated, there may be mentioned generally used phosphoric acid compounds or silane coupling agents, etc.

As the phosphoric acid compounds, there may be used at least one compound selected from the group consisting of orthophosphoric acid, disodium hydrogen phosphate, pyrophosphoric acid, metaphosphoric acid, manganese phosphate, zinc phosphate and aluminum phosphate.

Examples of the silane coupling agent used in the present invention include γ-(2-aminoethyl)aminopropyl trimethoxysilane, γ-(2-aminoethyl)aminopropylmethyl dimethoxysilane, γ-methacryloxypropyl trimethoxysilane, γ-methacryloxypropylmethyl dimethoxysilane, N-β-(N-vinylbenzylaminoethyl)-γ-aminopropyl trimethoxysilane hydrochloride, γ-glycidoxypropyl trimethoxysilane, γ-mercaptopropyl trimethoxysilane, methyl trimethoxysilane, methyl triethoxysilane, vinyl triacetoxysilane, γ-chloropropyl trimethoxysilane, hexamethylene disilazane, γ-anilinopropyl trimethoxysilane, vinyl trimethoxysilane, octadecyl [3-(trimethoxysilyl)propyl]ammonium chloride, γ-chloropropylmethyl dimethoxysilane, γ-mercaptopropylmethyl dimethoxysilane, methyl trichlorosilane, dimethyl dichlorosilane, trimethyl chlorosilane, vinyl trichlorosilane, vinyl tris(β-methoxyethoxy)silane, vinyl triethoxysilane, β-(3,4-epoxycyclohexyl)ethyl trimethoxysilane, γ-glycidoxypropylmethyl diethoxysilane, N-β-(aminoethyl) γ-aminopropyl trimethoxysilane, N-β-(aminoethyl) γ-aminopropylmethyl dimethoxysilane, γ-aminopropyl triethoxysilane, N-phenyl-γ-aminopropyl trimethoxysilane, oleylpropyl triethoxysilane, γ-isocyanatopropyl triethoxysilane, polyethoxydimethyl siloxane, polyethoxymethyl siloxane, bis(trimethoxysilylpropyl)amine, bis(3-triethoxysilylpropyl) tetrasulfane, γ-isocyanatopropyl trimethoxysilane, vinylmethyl dimethoxysilane, 1,3,5-N-tris(3-trimethoxysilylpropyl)isocyanurate, t-butyl carbamate trialkoxysilane, γ-glycidoxypropyl triethoxysilane, γ-methacryloxypropylmethyl diethoxysilane, γ-methacryloxypropyl triethoxysilane, N-β-(aminoethyl) γ-aminopropyl triethoxysilane, and 3-acryloxypropyl trimethoxysilane N-(1,3-dimethylbutylidene)-3-(triethoxysilyl)-1-propane amine.

In addition, alkoxy oligomers whose molecular end is sealed with an alkoxysilyl group may be used as the surface treating agent, according to the applications of the resulting bonded magnet.

The binder resin used in the resin composition for bonded magnets may be selected from various resins depending upon the molding method used. For example, in the case of using an injection molding method, an extrusion molding method or a calender molding method, thermoplastic resins may be used as the binder resin. In the case of using a compression molding method, thermosetting resins may be used as the binder resin. Examples of the thermoplastic resins used in the present invention include nylon (PA)-based resins, polypropylene (PP)-based resins, ethylene-vinyl acetate (EVA)-based resins, polyphenylene sulfide (PPS)-based resins, liquid crystal plastic (LCP)-based resins, elastomer-based resins and rubber-based resins. Examples of the thermosetting resins used in the present invention include epoxy-based resins and phenol-based resins.

Meanwhile, upon producing the resin composition for bonded magnets, in order to improve fluidity and moldability of the resin composition and allow the R-T-B-based rare earth magnet powder to exhibit sufficient magnetic properties thereof, the resin composition for bonded magnets may also comprise, in addition to the binder resin, various known additives such as a plasticizer, a lubricant and a coupling agent, if required. Further, various other kinds of magnet powder such as ferrite magnet powder may also be mixed in the resin composition.

These additives may be adequately selected according to the aimed applications of the resulting bonded magnet. As the plasticizer, commercially available products may be appropriately used according to the resins used. The total amount of the additives added to the resin composition is about 0.01 to about 5.0% by weight based on the weight of the binder resin.

Examples of the lubricant used in the present invention include stearic acid and derivatives thereof, inorganic lubricants, oil-based lubricants, etc. The lubricant may be used in an amount of about 0.01 to about 1.0% by weight based on a whole weight of the bonded magnet.

As the coupling agent, commercially available products may be used according to the resins and fillers used. The coupling agent may be used in an amount of about 0.01 to about 3.0% by weight based on the weight of the binder resin used.

As the other kinds of magnetic powder, there may be used ferrite magnet powder, Al—Ni—Co magnet powder, rare earth magnet powder or the like.

The resin composition for bonded magnets according to the present invention may be prepared by mixing and kneading the R-T-B-based magnetic powder and the binder resin with each other.

The mixing of the R-T-B-based rare earth magnet powder and the binder resin may be carried out using a mixing device such as a Henschel mixer, a V-shaped mixer and a Nauta mixer, whereas the kneading may be carried out using a single-screw kneader, a twin-screw kneader, a mill-type kneader, an extrusion kneader or the like.

Next, the bonded magnet according to the present invention is described.

The magnetic properties of the bonded magnet may variously changed according to the aimed applications of the resulting bonded magnet. The bonded magnet preferably has a remanent flux density of 350 to 1000 mT (3.5 to 10.0 kG), a coercive force of 238.7 to 1428.5 kA/m (3000 to 18000 Oe), and a maximum energy product of 23.9 to 198.9 kJ/$m^3$ (3 to 25 MGOe).

The density of the bonded magnet as the molded product is preferably 4.5 to 5.5 g/$cm^3$.

The bonded magnet according to the present invention may be produced by subjecting the aforementioned resin composition for bonded magnets to a molding process by a known molding method such as an injection molding method, an extrusion molding method, a compression molding method or a calender molding method, and then subjecting the resulting molded product to electromagnet magnetization or pulse magnetization by an ordinary method to thereby form the bonded magnet.

EXAMPLES

In the following, the magnet powder and the bonded magnet according to the present invention are described in more detail by Examples and Comparative Examples.

In the analysis of the average composition of the R-T-B-based rare earth magnet powder and the composition of the raw material alloy as described in the present invention, B and Al were analyzed using an ICP emission spectrophotometer "iCAP6000" manufactured by Thermo Fisher Scientific K.K., whereas the elements other than B and Al were analyzed using a fluorescent X-ray analyzer "RIX2011" manufactured by Rigaku Corporation.

As the magnetic properties of the R-T-B-based rare earth magnet powder according to the present invention, a coercive force (iHc), a maximum energy product ($(BH)_{max}$) and a remanent flux density (Br) of the magnet powder were measured using a vibrating sample type magnetic flux meter (VSM: "VSM-5 Model") manufactured by Toei Industry Co., Ltd.

As the magnetic properties of the bonded magnet according to the present invention, a coercive force (iHc), a maximum energy product ($(BH)_{max}$) and a remanent flux density (Br) of the bonded magnet were measured using a B—H tracer manufactured by Toei Industry Co., Ltd.

(Production of Raw Material Alloy Powder)

Alloy ingots A1 to A12 each having a composition shown in Table 1 below were produced. The thus produced alloy ingots were respectively subjected to heat treatment in an Ar atmosphere at a temperature of 1000 to 1200° C. for 20 hr to obtain a homogenized composition. After completion of the homogenization heat treatment, the resulting powder were subjected to coarse pulverization using a jaw crusher, and further subjected to hydrogen absorption and then mechanical pulverization, thereby obtaining raw material alloy powder A1 to A12.

TABLE 1

| | R | | T | | B |
|---|---|---|---|---|---|
| Kind | Pr atom % | Nd atom % | Fe atom % | Co atom % | B atom % |
| A1 | — | 12.9 | Bal. | 5.3 | 6.2 |
| A2 | 3.1 | 9.8 | Bal. | 5.3 | 6.2 |
| A3 | — | 13.1 | Bal. | 5.3 | 6.2 |
| A4 | 3.2 | 9.8 | Bal. | 5.3 | 6.2 |
| A5 | 2.7 | 9.4 | Bal. | 5.3 | 6.2 |
| A6 | 1.3 | 11.6 | Bal. | 5.3 | 6.2 |
| A7 | 1.9 | 11.0 | Bal. | 5.3 | 6.2 |
| A8 | 3.9 | 9.0 | Bal. | 5.3 | 6.2 |
| A9 | 5.2 | 7.7 | Bal. | 5.3 | 6.2 |
| A10 | 6.4 | 6.5 | Bal. | 5.3 | 6.2 |
| A11 | 9.0 | 3.9 | Bal. | 5.3 | 6.2 |
| A12 | 10.3 | 2.6 | Bal. | 5.3 | 6.2 |

| | Others | | |
|---|---|---|---|
| Kind | Al atom % | Ga atom % | Zr atom % |
| A1 | — | 0.5 | 0.1 |
| A2 | — | 0.5 | 0.1 |
| A3 | 1.5 | 0.5 | 0.1 |
| A4 | 1.5 | 0.5 | 0.1 |
| A5 | — | 0.5 | 0.1 |
| A6 | — | 0.5 | 0.1 |
| A7 | — | 0.5 | 0.1 |
| A8 | — | 0.5 | 0.1 |
| A9 | — | 0.5 | 0.1 |
| A10 | — | 0.5 | 0.1 |
| A11 | — | 0.5 | 0.1 |
| A12 | — | 0.5 | 0.1 |

Example 1

(HDDR Treatment: HD Step)

In the HD step, 5 kg of the raw material alloy powder A1 were charged into a furnace. Thereafter, the powder were heated to 840° C. in the furnace in a mixed gas of hydrogen and Ar maintained under a total pressure of 100 kPa (atmospheric pressure) having a hydrogen partial pressure of 60 kPa and held therein for 300 min.

(HDDR Treatment: Atmosphere Replacing Step)

After completion of the HD step, the inside atmosphere of the furnace was adjusted to an Ar atmosphere under 100 kPa, and then the resulting powder were held at 840° C. for 8 min.

(HDDR Treatment: Preliminary Evacuation Step)

After completion of the atmosphere replacing step, the resulting powder were subjected to a preliminary evacuation step in which an inside of the furnace was evacuated using a rotary pump until the vacuum degree inside the furnace reached 3.2 kPa. At this time, the rate of pressure reduction upon changing the furnace pressure from 100 kPa to 3.2 kPa was adjusted to 12.2 kPa/min. By controlling a valve opening degree of the vacuum evacuation system, the vacuum degree inside the furnace after the evacuation was held under 3.2 kPa at a treating temperature of 840° C. After the vacuum degree inside the furnace reached 3.2 kPa, the resulting powder were held for 20 min from the time at which the variation in temperature of the resulting product per 1 min fell within the range of 0.5° C. or less.

(HDDR Treatment: Complete Evacuation Step)

After completion of the preliminary evacuation step, the resulting powder were further subjected to a complete evacuation step in which the vacuum evacuation was further continued until the vacuum degree inside the furnace was dropped from 3.2 kPa and finally reached not more than 1

Pa. While maintaining the treating temperature at 840° C., the resulting powder were held for 20 min from the time at which the variation in temperature of the resulting product per 1 min fell within the range of 0.5° C. or less. The resulting powder were cooled to thereby obtain R-T-B-based rare earth magnet powder. The magnetic properties of the thus obtained R-T-B-based rare earth magnet powder are shown in Table 2.

Examples 2 to 4 and Comparative Example 1

The same procedure as in Example 1 was conducted except that the rates of pressure reduction in the preliminary evacuation step were respectively changed as shown in Table 2, thereby obtaining R-T-B-based rare earth magnet powder.

Example 5

The same procedure as in Example 1 was conducted except that the raw material alloy powder A2 were used instead, thereby obtaining R-T-B-based rare earth magnet powder.

Examples 6 to 8 and Comparative Example 2

The same procedure as in Example 5 was conducted except that the rates of pressure reduction in the preliminary evacuation step were respectively changed as shown in Table 2, thereby obtaining R-T-B-based rare earth magnet powder.

Example 9

The same procedure as in Example 1 was conducted except that the raw material alloy powder A3 were used instead, thereby obtaining R-T-B-based rare earth magnet powder.

Examples 10 to 12 and Comparative Example 3

The same procedure as in Example 9 was conducted except that the rates of pressure reduction in the preliminary evacuation step were respectively changed as shown in Table 2, thereby obtaining R-T-B-based rare earth magnet powder.

Example 13

The same procedure as in Example 1 was conducted except that the raw material alloy powder A4 were used instead, thereby obtaining R-T-B-based rare earth magnet powder.

Examples 14 to 16 and Comparative Example 4

The same procedure as in Example 13 was conducted except that the rates of pressure reduction in the preliminary evacuation step were changed to 6.5 kPa/min (Example 14), 3.3 kPa/min (Example 15), 1.6 kPa/min (Example 16) and 38.7 kPa/min (Comparative Example 4), respectively, thereby obtaining R-T-B-based rare earth magnet powder.

Example 17

The same procedure as in Example 1 was conducted except that the raw material alloy powder A5 were used instead, thereby obtaining R-T-B-based rare earth magnet powder.

Examples 18 to 20 and Comparative Example 5

The same procedure as in Example 17 was conducted except that the rates of pressure reduction in the preliminary evacuation step were respectively changed as shown in Table 2, thereby obtaining R-T-B-based rare earth magnet powder.

Examples 21 to 27

The same procedure as in Example 2 was conducted except that the raw material alloy powder were respectively changed as shown in Table 2, thereby obtaining R-T-B-based rare earth magnet powder.

Examples 28 and 29

The same procedure as in Example 2 was conducted except that the vacuum degrees after the evaluation in the preliminary evacuation step were respectively changed as shown in Table 2, thereby obtaining R-T-B-based rare earth magnet powder.

TABLE 2

| Examples and Comparative Examples | Alloy used | Pr content atom % | Nd content atom % | Ratio of Pr based on R atom % | Al content atom % |
|---|---|---|---|---|---|
| Example 1 | A1 | — | 12.9 | 0 | — |
| Example 2 | A1 | — | 12.9 | 0 | — |
| Example 3 | A1 | — | 12.9 | 0 | — |
| Example 4 | A1 | — | 12.9 | 0 | — |
| Comparative Example 1 | A1 | — | 12.9 | 0 | — |
| Example 5 | A2 | 3.1 | 9.8 | 24 | — |
| Example 6 | A2 | 3.1 | 9.8 | 24 | — |
| Example 7 | A2 | 3.1 | 9.8 | 24 | — |
| Example 8 | A2 | 3.1 | 9.8 | 24 | — |
| Comparative Example 2 | A2 | 3.1 | 9.8 | 24 | — |
| Example 9 | A3 | — | 13.1 | 0 | 1.5 |
| Example 10 | A3 | — | 13.1 | 0 | 1.5 |
| Example 11 | A3 | — | 13.1 | 0 | 1.5 |
| Example 12 | A3 | — | 13.1 | 0 | 1.5 |
| Comparative Example 3 | A3 | — | 13.1 | 0 | 1.5 |
| Example 13 | A4 | 3.2 | 9.9 | 24 | 1.5 |
| Example 14 | A4 | 3.2 | 9.9 | 24 | 1.5 |
| Example 15 | A4 | 3.2 | 9.9 | 24 | 1.5 |
| Example 16 | A4 | 3.2 | 9.9 | 24 | 1.5 |
| Comparative Example 4 | A4 | 3.2 | 9.9 | 24 | 1.5 |
| Example 17 | A5 | 2.7 | 9.4 | 24 | — |
| Example 18 | A5 | 2.7 | 9.4 | 24 | — |
| Example 19 | A5 | 2.7 | 9.4 | 24 | — |
| Example 20 | A5 | 2.7 | 9.4 | 24 | — |
| Comparative Example 5 | A5 | 2.7 | 9.4 | 24 | — |
| Example 21 | A6 | 1.3 | 11.6 | 10 | — |
| Example 22 | A7 | 1.9 | 11.0 | 15 | — |
| Example 23 | A8 | 3.9 | 9.0 | 30 | — |
| Example 24 | A9 | 5.2 | 7.7 | 40 | — |
| Example 25 | A10 | 6.4 | 6.5 | 50 | — |
| Example 26 | A11 | 9.0 | 3.9 | 70 | — |
| Example 27 | A12 | 10.3 | 2.6 | 80 | — |

TABLE 2-continued

| | | | | | |
|---|---|---|---|---|---|
| Example 28 | A4 | 3.2 | 9.9 | 24 | — |
| Example 29 | A4 | 3.2 | 9.9 | 24 | — |

| Examples and Comparative Examples | Rate of pressure reduction in preliminary evacuation kPa/min | Vacuum degree reached in preliminary evacuation kPa | $B_r$ T | $iH_c$ kA/m | $(BH)_{max}$ kJ/m$^3$ |
|---|---|---|---|---|---|
| Example 1 | 12.2 | 3.2 | 1.33 | 1149 | 333 |
| Example 2 | 6.5 | 3.2 | 1.36 | 1117 | 342 |
| Example 3 | 3.3 | 3.2 | 1.37 | 1085 | 342 |
| Example 4 | 1.6 | 3.2 | 1.39 | 997 | 348 |
| Comparative Example 1 | 38.7 | 3.2 | 1.30 | 1197 | 302 |
| Example 5 | 12.2 | 3.2 | 1.34 | 1260 | 329 |
| Example 6 | 6.5 | 3.2 | 1.38 | 1228 | 353 |
| Example 7 | 3.3 | 3.2 | 1.39 | 1197 | 358 |
| Example 8 | 1.6 | 3.2 | 1.40 | 1141 | 353 |
| Comparative Example 2 | 38.7 | 3.2 | 1.31 | 1292 | 317 |
| Example 9 | 12.2 | 3.2 | 1.27 | 1324 | 293 |
| Example 10 | 6.5 | 3.2 | 1.29 | 1292 | 309 |
| Example 11 | 3.3 | 3.2 | 1.32 | 1244 | 320 |
| Example 12 | 1.6 | 3.2 | 1.34 | 1213 | 333 |
| Comparative Example 3 | 38.7 | 3.2 | 1.20 | 1380 | 259 |
| Example 13 | 12.2 | 3.2 | 1.28 | 1388 | 304 |
| Example 14 | 6.5 | 3.2 | 1.32 | 1372 | 317 |
| Example 15 | 3.3 | 3.2 | 1.34 | 1340 | 324 |
| Example 16 | 1.6 | 3.2 | 1.35 | 1276 | 326 |
| Comparative Example 4 | 38.7 | 3.2 | 1.24 | 1436 | 286 |
| Example 17 | 12.2 | 3.2 | 1.38 | 925 | 307 |
| Example 18 | 6.5 | 3.2 | 1.40 | 885 | 331 |
| Example 19 | 3.3 | 3.2 | 1.41 | 862 | 334 |
| Example 20 | 1.6 | 3.2 | 1.42 | 814 | 338 |
| Comparative Example 5 | 38.7 | 3.2 | 1.36 | 965 | 290 |
| Example 21 | 6.5 | 3.2 | 1.35 | 1207 | 334 |
| Example 22 | 6.5 | 3.2 | 1.35 | 1217 | 338 |
| Example 23 | 6.5 | 3.2 | 1.36 | 1230 | 345 |
| Example 24 | 6.5 | 3.2 | 1.37 | 1276 | 349 |
| Example 25 | 6.5 | 3.2 | 1.36 | 1248 | 347 |
| Example 26 | 6.5 | 3.2 | 1.35 | 1236 | 341 |
| Example 27 | 6.5 | 3.2 | 1.34 | 1213 | 332 |
| Example 28 | 6.5 | 2.0 | 1.29 | 1388 | 296 |
| Example 29 | 6.5 | 4.7 | 1.33 | 1316 | 326 |

Examples 30 to 33 and Comparative Examples 6 to 9

(Production of Bonded Magnet)

Bonded magnets were produced using the R-T-B-based rare earth magnet powder shown in Table 3 by the following method.

(Surface Treatment of Magnet Powder)

A universal stirrer was charged with 7000 g of the R-T-B-based rare earth magnet powder. Then, a mixed solution comprising 35 g of orthophosphoric acid (0.5% by weight based on the magnet powder) and 175 g of IPA (2.5% by weight based on the magnet powder) was added into the universal stirrer, and the mixed solution was stirred together with the R-T-B-based rare earth magnet powder in the universal stirrer at an ordinary temperature in air for 10 min. Thereafter, the obtained mixture was subjected to heat treatment at 80° C. for 1 hr, and then at 120° C. for 1 hr, in air under atmospheric pressure while stirring, thereby obtaining the R-T-B-based rare earth magnet powder whose surface was coated with the phosphoric acid compound coating layer. Added to 7000 g of the thus obtained R-T-B-based rare earth magnet powder whose surface was coated with the phosphoric acid compound coating layer was a mixed solution comprising 35 g of a silane coupling agent (γ-aminopropyl triethoxysilane; 0.5% by weight based on the R-T-B-based rare earth magnet powder), 175 g of IPA (2.5% by weight based on the R-T-B-based rare earth magnet powder) and 7 g of pure water (0.1% by weight based on the R-T-B-based rare earth magnet powder), and the mixed solution was stirred together with the R-T-B-based rare earth magnet powder using a universal stirrer at an ordinary temperature in a nitrogen gas atmosphere for 10 min. Thereafter, the resulting mixture was subjected to heat treatment while stirring at 100° C. in a nitrogen atmosphere for 1 hr, and then cooled, followed by taking out the obtained magnet powder from the reactor. Then, the thus obtained magnet powder were subjected to heat treatment at 120° C. in an inert gas atmosphere under atmospheric pressure for 2 hr, thereby obtaining the surface-treated R-T-B-based rare earth magnet powder whose surface was coated with the phosphoric acid compound coating layer onto which Si of the coupling agent was further adhered.

(Kneading)

One hundred parts by weight of the thus obtained surface-treated R-T-B-based rare earth magnet powder, 5.06 parts by weight of a nylon-12 resin, 0.80 part by weight of an antioxidant and 0.22 part by weight of a lubricant were mixed with each other using a Henschel mixer, and the resulting mixture was kneaded (at a kneading temperature of 190° C.) using a twin-screw kneader, thereby obtaining a resin composition for bonded magnets in the form of pellets.

(Molding)

The thus obtained resin composition for bonded magnets was injection-molded, and the resulting molded product was magnetized by an ordinary method to obtain a bonded magnet. Magnetic properties of the thus obtained bonded magnet are shown in Table 3.

TABLE 3

| Examples and Comparative Examples | Magnet powder used | Alloy used | Pr content atom % | Nd content atom % | Ratio of Pr based on R atom % |
|---|---|---|---|---|---|
| Example 30 | Example 3 | A1 | — | 12.9 | 0 |
| Comparative Example 6 | Comparative Example 1 | A1 | — | 12.9 | 0 |
| Example 31 | Example 7 | A2 | 3.1 | 9.8 | 24 |
| Comparative Example 7 | Comparative Example 2 | A2 | 3.1 | 9.8 | 24 |
| Example 32 | Example 10 | A3 | — | 13.1 | 0 |
| Comparative Example 8 | Comparative Example 3 | A3 | — | 13.1 | 0 |
| Example 33 | Example 14 | A4 | 3.2 | 9.9 | 24 |
| Comparative Example 9 | Comparative Example 4 | A4 | 3.2 | 9.9 | 24 |

| Examples and Comparative Examples | Al content atom % | Molding density g/cm$^3$ | $B_r$ mT | $iH_c$ kA/m | $(BH)_{max}$ kJ/m$^3$ |
|---|---|---|---|---|---|
| Example 30 | — | 5.35 | 8910 | 919 | 128 |
| Comparative Example 6 | — | 5.35 | 8400 | 1021 | 112 |
| Example 31 | — | 5.35 | 8930 | 1031 | 136 |
| Comparative Example 7 | — | 5.35 | 8329 | 1124 | 120 |
| Example 32 | 1.5 | 5.35 | 8030 | 1130 | 105 |
| Comparative Example 8 | 1.5 | 5.35 | 7584 | 1216 | 97 |
| Example 33 | 1.5 | 5.35 | 8135 | 1200 | 110 |

TABLE 3-continued

| | | | | | |
|---|---|---|---|---|---|
| Comparative Example 9 | 1.5 | 5.35 | 7685 | 1288 | 106 |

(Results)

As shown in Examples 1 to 4 and Comparative Example 1, the magnet powder having an enhanced remanent flux density were obtained by reducing a rate of pressure reduction caused by the evacuation upon initiation of the preliminary evacuation step. In this case, the mechanism of the enhancement in remanent flux density of the magnet powder is considered to be that an initial driving force of the hydrogen desorption-recombination reaction is lowered by reducing the rate of pressure reduction, so that crystal orientation of the recombined $Nd_2Fe_{14}B$ grain is aligned in one direction. For example, in the case where the evacuation is rapidly carried out only in the complete evacuation step without conducting the preliminary evacuation step, the rate of the hydrogen desorption reaction is extremely increased and the recombination reaction occurs simultaneously and frequently, so that the crystal orientation of the recombined $Nd_2Fe_{14}B$ grain becomes random to thereby fail to obtain magnet powder having a high anisotropic degree. In contrast, it is considered that in the present invention, a rate of the evacuation is decreased to thereby allow the hydrogen desorption reaction to proceed slowly, and therefore the growth of the recombined $Nd_2Fe_{14}B$ grain is gradually caused, so that the degree of crystal orientation of the recombined $Nd_2Fe_{14}B$ grain along one direction is likely to become increased.

Figure 2:
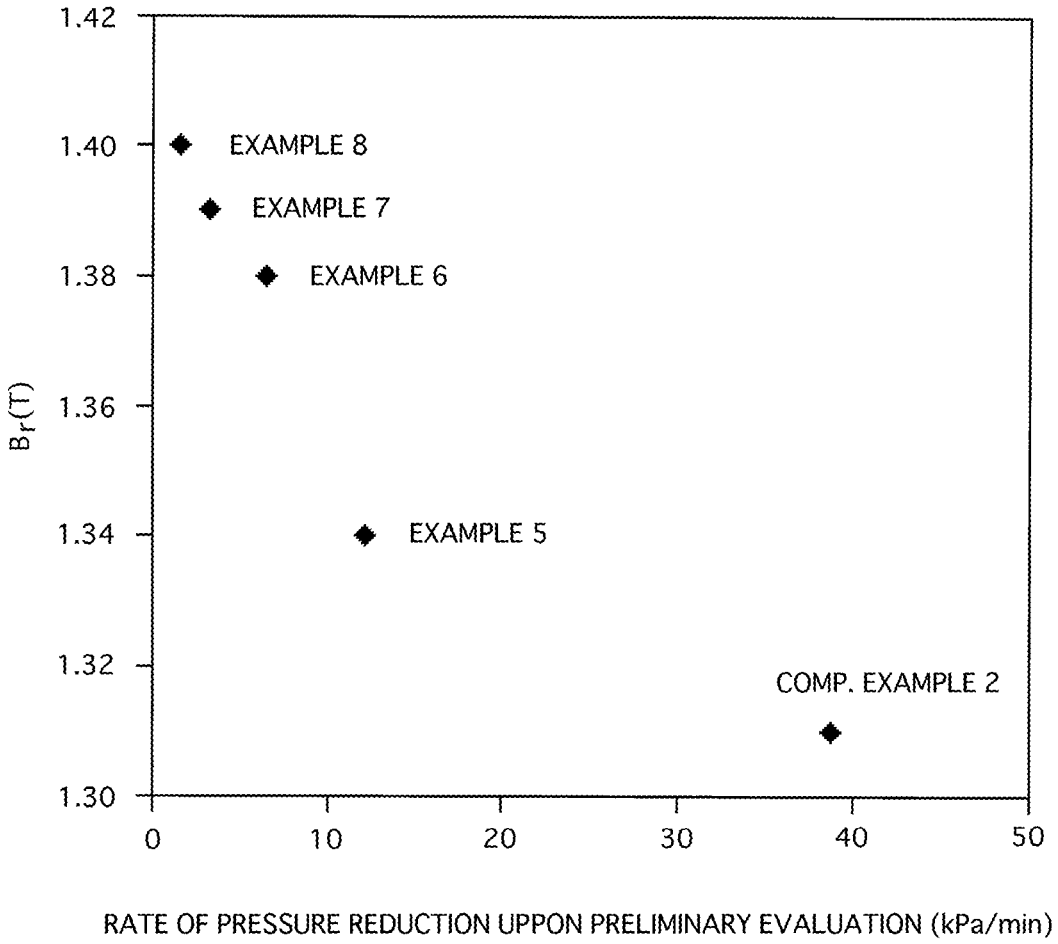
FIG. 2 shows a graph illustrating a change in remanent flux density with respect to a rate of pressure reduction in the preliminary evacuation step.

In FIG. 2, there is shown the relationship between a rate of pressure reduction and a remanent flux density in the preliminary evacuation step in Examples 5 to 8 and Comparative Example 2. As shown in Table 2 and FIG. 2, as the rate of pressure reduction is decreased, the remanent flux density is increased, and the maximum energy product is also enhanced. As the maximum energy product of the magnet is enhanced, the volume of the magnet which is required to generate the same magnetic field is reduced, i.e., the magnet having the same volume is capable of generating a stronger magnetic field as compared to the magnet having a reduced maximum energy product. However, as the rate of pressure reduction is decreased, the coercive force tends to be reduced.

In order to enhance coercive force of the magnet powder, it is effective to use a mixed rare earth material Nd—Pr as R. When comparing Examples 5 to 8 using the magnet powder comprising Pr with the magnet powder of Comparative Example 2, the magnet powder obtained in the respective Examples in which the rate of pressure reduction in the preliminary evacuation step was controlled to the range of 1.6 to 12.2 kPa/min were enhanced in coercive force and remanent flux density.

In addition, it is also possible to obtain magnet powder having an enhanced coercive force by adding Al thereto. As shown in Examples 9 to 12, the magnet powder obtained therein were enhanced in remanent flux density by controlling the rate of pressure reduction in the preliminary evacuation step to the range of 1.6 to 12.2 kPa/min.

Further, as shown in Examples 13 to 16, the magnet powder comprising Pr and Al were enhanced in remanent flux density and exhibited higher coercive force by controlling the rate of pressure reduction in the preliminary evacuation step to the range of 1.6 to 12.2 kPa/min. In particular, with respect to the magnetic properties, the magnet powder obtained in Examples 13 and 14 were superior in remanent flux density to the magnet powder of Comparative Example 3 in which only pure Nd was used as R, though the former powder were substantially identical in coercive force to the latter powder.

As shown in Examples 17 to 27, it was recognized that even in the case where the total amount of the R elements or the amount of Pr among the R elements was changed variously, the enhancement in remanent flux density by controlling the rate of pressure reduction in the preliminary evacuation step was effective to enhance magnetic properties thereof.

In Examples 28 and 29, there are shown the results obtained in the case where the vacuum degree after the evaluation in the preliminary evacuation step was changed variously, and it is also shown that the remanent flux density was able to be enhanced by controlling the vacuum degree after the evaluation in the preliminary evacuation step.

When comparing the bonded magnets obtained in Example 30 and Comparative Example 6 in which the magnet powder having the same composition comprising the raw material alloy A1 were used, the magnet powder of Comparative Example 1 having a low remanent flux density were used in Comparative Example 6, whereas the magnet powder of Example 3 which were enhanced in remanent flux density by controlling the rate of pressure reduction were used in Example 30. For this reason, it was also confirmed that the bonded magnet of Example 30 had a higher remanent flux density than the bonded magnet of Comparative Example 6.

The bonded magnets obtained in Examples 31 to 33 had the same composition as that of the bonded magnets obtained in Comparative Examples 7 to 9, but were different in remanent flux density therefrom. Therefore, the bonded magnets obtained in Examples 31 to 33 were more excellent in magnetic properties than the bonded magnets obtained in Comparative Examples 7 to 9 owing to the difference in magnetic properties of the magnet powder used as the raw material therein.

When comparing the bonded magnets obtained in Examples 30 and 31 with each other, it was confirmed that although both the bonded magnets were substantially identical in remanent flux density to each other, the bonded magnet of Example 31 comprising Pr had a higher coercive force than the bonded magnet of Example 30.

Furthermore, in Examples 32 and 33, there are shown the magnetic properties of the bonded magnets that were enhanced in coercive force by adding Al thereto. With respect to these bonded magnets, it was also confirmed that the bonded magnet of Example 33 comprising Pr had a higher coercive force than the bonded magnet of Example 32.

INDUSTRIAL APPLICABILITY

In accordance with the process for producing R-T-B-based rare earth magnet powder according to the present invention, by controlling a rate of pressure reduction in a preliminary evacuation step, it is possible to enhance remanent flux density of the R-T-B-based rare earth magnet powder. In addition, by adding Pr as a constituting element of R, it is possible to enhance coercive force of the R-T-B-based rare earth magnet powder without reducing a remanent flux density thereof. By combining both of the aforementioned features, it is possible to obtain the R-T-B-based rare earth magnet powder that are excellent in all of remanent flux density, coercive force and maximum energy product. As a result, the R-T-B-based rare earth magnet powder of the present invention can be used in a high temperature environmental condition, for example, in an engine room of automobiles in which the conventional R-T-B-based rare earth magnet powder could not be used because the magnetic force is low in spite of the high coercive force. Further, it is possible to reduce an amount of the magnet used owing to a high magnetic force thereof, and therefore, there is a merit of reducing a weight of the magnet as compared to existing products.

The invention claimed is:

1. A process for producing R-T-B-based rare earth magnet powder by HDDR (Hydrogenation-Decomposition-Desorption-Recombination) treatment, in which a raw material alloy for the R-T-B-based rare earth magnet powder comprises R (wherein R represents at least one rare earth element including Y), T (wherein T represents Fe, or Fe and Co) and B (wherein B represents boron), and has a composition comprising R in an amount of not less than 12.0 atom % and not more than 17.0 atom %, and B in an amount of not less than 4.5 atom % and not more than 7.5 atom %;

the HDDR treatment comprises:

an HD (Hydrogenation-Decomposition) step using a furnace, an atmosphere replacing step comprising replacing an inside atmosphere of the furnace with Ar, and subsequently a DR Desorption-Recombination step comprising a preliminary evacuation step and a complete evacuation step; and a rate of pressure reduction caused by evacuation in the preliminary evacuation step is always held constant or changed during the evacuation within a range of not less than 1 kPa/min and not more than 6.5 kPa/min, wherein a vacuum degree after the evacuation in the preliminary evacuation step is not less than 1.0 kPa and not more than 5.0 kPa, wherein the raw material alloy comprises at least Nd and Pr as R (wherein R represents at least one rare earth element including Y), and a content of Pr in R is not less than 10 atom % and not more than 80 atom %, wherein the remanent flux density (Br) of the R-T-B-based rare earth magnet powder is not less than 1.29 T.

2. The process for producing R-T-B-based rare earth magnet powder according to claim 1, wherein a treating temperature in the preliminary evacuation step is not lower than 800° C. and not higher than 900° C.

3. The process for producing R-T-B-based rare earth magnet powder according to claim 1, wherein the raw material alloy further comprises Al, and has a composition comprising Al in an amount of not less than 0.1 atom % and not more than 5.0 atom %.

4. The process for producing R-T-B-based rare earth magnet powder according to claim 1, wherein the raw material alloy further comprises Ga and Zr, and has a composition comprising Co in an amount of not more than 15.0 atom %, Ga in an amount of not less than 0.1 atom % and not more than 0.6 atom %, and Zr in an amount of not less than 0.05 atom % and not more than 0.15 atom %.

5. The process for producing R-T-B-based rare earth magnet powder according to claim 1, wherein the atmosphere replacing step is conducted at a treating temperature of not lower than 700° C. and not higher than 870° C. and the treating time of the atmosphere replacing step is not less than 1 min and not more than 30 min.

6. A process for producing R-T-B-based rare earth magnet powder by HDDR (Hydrogenation-Decomposition-Desorption-Recombination) treatment, in which a raw material alloy for the R-T-B-based rare earth magnet powder comprises R (wherein R represents at least one rare earth element including Y), T (wherein T represents Fe, or Fe and Co) and B (wherein B represents boron), and has a composition comprising R in an amount of not less than 12.0 atom % and not more than 17.0 atom %, and B in an amount of not less than 4.5 atom % and not more than 7.5 atom %;

the HDDR treatment comprises:

an HD (Hydrogenation-Decomposition) step using a furnace, an atmosphere replacing step comprising replacing an inside atmosphere of the furnace with Ar, and subsequently a DR (Desorption-Recombination) step comprising a preliminary evacuation step and a complete evacuation step; and a rate of pressure reduction caused by evacuation in the preliminary evacuation step is always held constant or changed during the evacuation within a range of not less than 1 kPa/min and not more than 6.5 kPa/min, wherein a vacuum degree after the evacuation in the preliminary evacuation step is not less than 1.0 kPa and not more than 5.0 kPa, wherein the raw material alloy comprises at least Nd and Pr as R (wherein R represents at least one rare earth element including Y), and a content of Pr in R is not less than 10 atom % and not more than 80 atom %, wherein the maximum energy product ($(BH)_{max}$) of the R-T-B-based rare earth magnet powder is not less than 296 $kJ/m^3$.

7. The process for producing R-T-B-based rare earth magnet powder according to claim 6, wherein a treating temperature in the preliminary evacuation step is not lower than 800° C. and not higher than 900° C.

8. The process for producing R-T-B-based rare earth magnet powder according to claim 6, wherein the raw material alloy further comprises Al, and has a composition comprising Al in an amount of not less than 0.1 atom % and not more than 5.0 atom %.

9. The process for producing R-T-B-based rare earth magnet powder according to claim 6, wherein the raw material alloy further comprises Ga and Zr, and has a composition comprising Co in an amount of not more than 15.0 atom %, Ga in an amount of not less than 0.1 atom % and not more than 0.6 atom %, and Zr in an amount of not less than 0.05 atom % and not more than 0.15 atom %.

* * * * *